US009861190B2

(12) United States Patent
Lee

(10) Patent No.: US 9,861,190 B2
(45) Date of Patent: Jan. 9, 2018

(54) WOOD GANG FORM AND METHOD FOR CONSTRUCTING CONCRETE BUILDING USING SAME

(71) Applicant: SEOBO INDUSTRIAL CO., LTD., Chungcheongbuk-do (KR)

(72) Inventor: Bum Su Lee, Chungcheongbuk-do (KR)

(73) Assignee: SEOBO INDUSTRIAL CO., LTD., Chungcheongbuk-Do (KR)

( * ) Notice: Subject to any disclaimer, the term of this patent is extended or adjusted under 35 U.S.C. 154(b) by 10 days.

(21) Appl. No.: 15/138,223

(22) Filed: Apr. 26, 2016

(65) Prior Publication Data

US 2016/0319558 A1 Nov. 3, 2016

(30) Foreign Application Priority Data

Apr. 30, 2015 (KR) ..... 10-2015-0062000

(51) Int. Cl.

| | |
|---|---|
| ***E04B 1/00*** | (2006.01) |
| ***A47B 13/00*** | (2006.01) |
| ***E04G 9/04*** | (2006.01) |
| ***E04G 17/00*** | (2006.01) |
| ***E04G 17/04*** | (2006.01) |
| ***E04G 17/065*** | (2006.01) |
| ***E04G 17/14*** | (2006.01) |
| ***E04G 19/00*** | (2006.01) |
| *E04G 9/02* | (2006.01) |

(52) U.S. Cl.

CPC ..... *A47B 13/003* (2013.01); *E04G 9/04* (2013.01); *E04G 17/002* (2013.01); *E04G 17/04* (2013.01); *E04G 17/0651* (2013.01); *E04G 17/14* (2013.01); *E04G 19/003* (2013.01); *E04G 2009/028* (2013.01)

(58) Field of Classification Search

CPC ..... A47B 13/003; E04G 17/002; E04G 17/14; E04G 17/0651; E04G 17/04; E04G 19/003; E04G 9/04; E04G 2009/028

USPC ..... 52/742.14; 249/190, 191, 192

See application file for complete search history.

(56) References Cited

U.S. PATENT DOCUMENTS 3,661,354 A * 5/1972 Dagiel ..... E04G 11/10 249/192
3,899,155 A * 8/1975 Ward ..... E04G 11/10 249/189
4,228,986 A * 10/1980 Schimmel ..... E04G 17/00 249/191

(Continued)

FOREIGN PATENT DOCUMENTS

KR 20-1987-0000792 Y1 2/1987
KR 10-2003-0017920 A 3/2003

(Continued)

OTHER PUBLICATIONS

Korean Utility Model Laid-open No. 87-792, "Connector for Panel to Fill Concrete Wall".

*Primary Examiner* — Basil Katcheves
(74) *Attorney, Agent, or Firm* — Revolution IP, PLLC

(57) ABSTRACT

Disclosed is a wood gang form including: a placing plate made with wood; a frame joined to the edge of one side of the placing plate; and a plurality of joist members which are arranged on one side of the placing plate at a predetermined interval from each other, are joined to one of the placing plate and the frame to reinforce the placing plate or the frame.

11 Claims, 11 Drawing Sheets

(56) References Cited

U.S. PATENT DOCUMENTS

| | | | | | |
|---|---|---|---|---|---|
| 5,836,126 | A * | 11/1998 | Harkenrider | E04G 9/05 | 249/216 |
| 8,011,637 | B2 * | 9/2011 | Trimmer | E04G 17/047 | 249/191 |
| 8,272,620 | B2 * | 9/2012 | Schwoerer | E04G 17/0752 | 249/190 |
| 8,616,520 | B2 * | 12/2013 | Baader | E04B 2/8647 | 249/216 |
| 2004/0079860 | A1 * | 4/2004 | Ward | E04G 17/0651 | 249/33 |
| 2005/0047855 | A1 * | 3/2005 | Trimmer | E04G 17/04 | 403/321 |
| 2005/0061948 | A1 * | 3/2005 | Brennan | B28B 7/0014 | 249/167 |
| 2008/0017783 | A1 * | 1/2008 | Vanagan | E04G 17/045 | 249/192 |

FOREIGN PATENT DOCUMENTS

| | | | |
|---|---|---|---|
| KR | 10-005-0021416 | A | 3/2005 |
| KR | 10-1008411 | B1 | 1/2011 |
| KR | 20-0459960 | Y1 | 4/2012 |
| KR | 10-2012-0046854 | A | 5/2012 |
| KR | 10-1207013 | B1 | 12/2012 |
| KR | 10-1489385 | B1 | 2/2015 |

* cited by examiner

WOOD GANG FORM AND METHOD FOR CONSTRUCTING CONCRETE BUILDING USING SAME

CROSS REFERENCE TO PRIOR APPLICATIONS

This application claims priority under 35 U.S.C. §119 to Korean Patent Application No. 10-2015-0062000, filed on Apr. 30, 2015, which is hereby incorporated by reference in its entirety.

BACKGROUND OF THE INVENTION

Field of the Invention

The present invention relates to a wood gang form, and more particularly, to a wood gang form and a method for constructing a concrete building using the same, which can simplify a structure, allow equipment of various kinds for construction of a concrete building, such as a lifting ring, a form tier, a bracing and a worktable, to be freely applied to the wood gang form, and enable a worker to work rapidly in safety.

Background Art

In general, in order to construct a reinforced concrete building, a framework of the building is constructed through the steps of arranging reinforcing bars to form a frame, installing a plurality of molds on the outside of the frame, placing concrete into the molds and curing the concrete for a predetermined period of time.

In case of such molds, it takes much time to manufacture the molds because the molds are made with a plurality of wood panels, and it is impossible to reuse the molds because most of the molds are damaged while being removed from the frame after curing of concrete. Moreover, for arrangement of the reinforcing bars and exterior finish work of the building, scaffolds are additionally installed, but it is impossible to reuse the scaffolds once they are used.

Recently, construction of high-rise buildings and large-sized buildings is on the increase. In order to place concrete for such high-rise buildings, large-sized molds (so-called "gang form") are used.

The gang form includes: a placing plate; a frame mounted on a peripheral surface of one side of the placing plate; and a joist member and a yoke member which are mounted on the placing plate inside the frame in the orthogonal direction to each other to reinforce the placing plate. The placing plate may be made with wood or a steel plate.

The wood gang form according to a prior art is just a large-sized mold, and is very inconvenient in installation and use and is deteriorated in quality and constructability of large-sized buildings because it does not have any suitable structure for installing equipment for placing concrete, such as a lifting ring, a form tier for keeping an interval between molds, a bracing for supporting the wood gang form and a worktable for providing a work space. Furthermore, the above-mentioned equipment can be installed using a pair of joist members and yoke members. So, the prior art has a disadvantage in that too many joist members and yoke members are used.

Cited reference 1 (Korean Patent No. 10-1207013) discloses a gang form prefabricated by aluminum panel including: a plurality of aluminum panels each of which has a rectangular flat plate abutting on concrete and a connection frame formed at the edge of the flat plate and which are connected with each other by connection members; and horizontal supporters fixed to the outer faces of the panels, wherein the rectangular flat plate includes a plurality of through holes which are formed in the vertical direction so that a plurality of connection bars penetrate through the through holes and reinforcing frames which outwardly protrude at the right and left of the through holes on the back of the rectangular flat plate to the same height as the connection frames so as to be elongated in the vertical direction of the panels, wherein a tie bolt is disposed between an inner panel and the gang form to maintain a predetermined interval between the inner panel and the gang form in such a way that an end of the tie bolt is fixed to a yoke through the through hole so as to fasten the tie bolt to the fabricated gang form, wherein a worktable having a horizontal frame and a vertical frame which are connected with each other is mounted on the outer face of the gang form in such a way that an end of the horizontal frame mounted on the outer face of the gang form is located between the two reinforcing frames so that coupling means are inserted and fixed into coupling holes of the reinforcing frames and the horizontal frame, and wherein a lower connection member which has coupling holes formed at predetermined intervals to correspond to the coupling holes formed in the reinforcing frame is connected to or disconnected from the reinforcing frame of the aluminum panel through the coupling means. However, the gang form is prefabricated but has no structure allowing application of the equipment, such as the lifting ring, the form tier for keeping an interval between molds, the bracing for supporting the wood gang form and the worktable for providing a work space.

CITED REFERENCES

Patent Documents

Cited Reference 1: Korean Patent No. 10-1207013

SUMMARY OF THE INVENTION

Accordingly, the present invention has been made in view of the above-mentioned problems occurring in the prior art, and it is an object of the present invention to provide a wood gang form and a method for constructing a concrete building using the same, which can simplify a structure, allow equipment of various kinds for construction of a concrete building, such as a lifting ring, a form tier, a bracing and a worktable, to be freely applied to the wood gang form, and enable a worker to work rapidly in safety.

To accomplish the above object, according to the present invention, there is provided a wood gang form including: a placing plate made with wood; a frame joined to the edge of one side of the placing plate; and a plurality of joist members which are arranged on one side of the placing plate at a predetermined interval from each other, are joined to one of the placing plate and the frame to reinforce the placing plate or the frame, wherein the joist member includes: a joist body which has a three-dimensional shape and is supported on the placing plate; and one or more through holes which are formed in the joist body in a circular form or an elongated form and to which equipment for placing concrete is connected, and the through holes are a first through hole which penetrates a front portion of the joist member in the back and forth direction and a second through hole which penetrates at least one of the upper and lower portions of the joist body in the vertical direction.

According to the present invention, the wood gang form and the method for constructing a concrete building using the same can simplify the structure through the structure (through holes) of the joist, allow equipment of various kinds for construction of a concrete building, such as a lifting ring, a form tier, a bracing and a worktable, to be freely applied to the wood gang form, and enable a worker to work rapidly in safety.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENT

Figure 1:
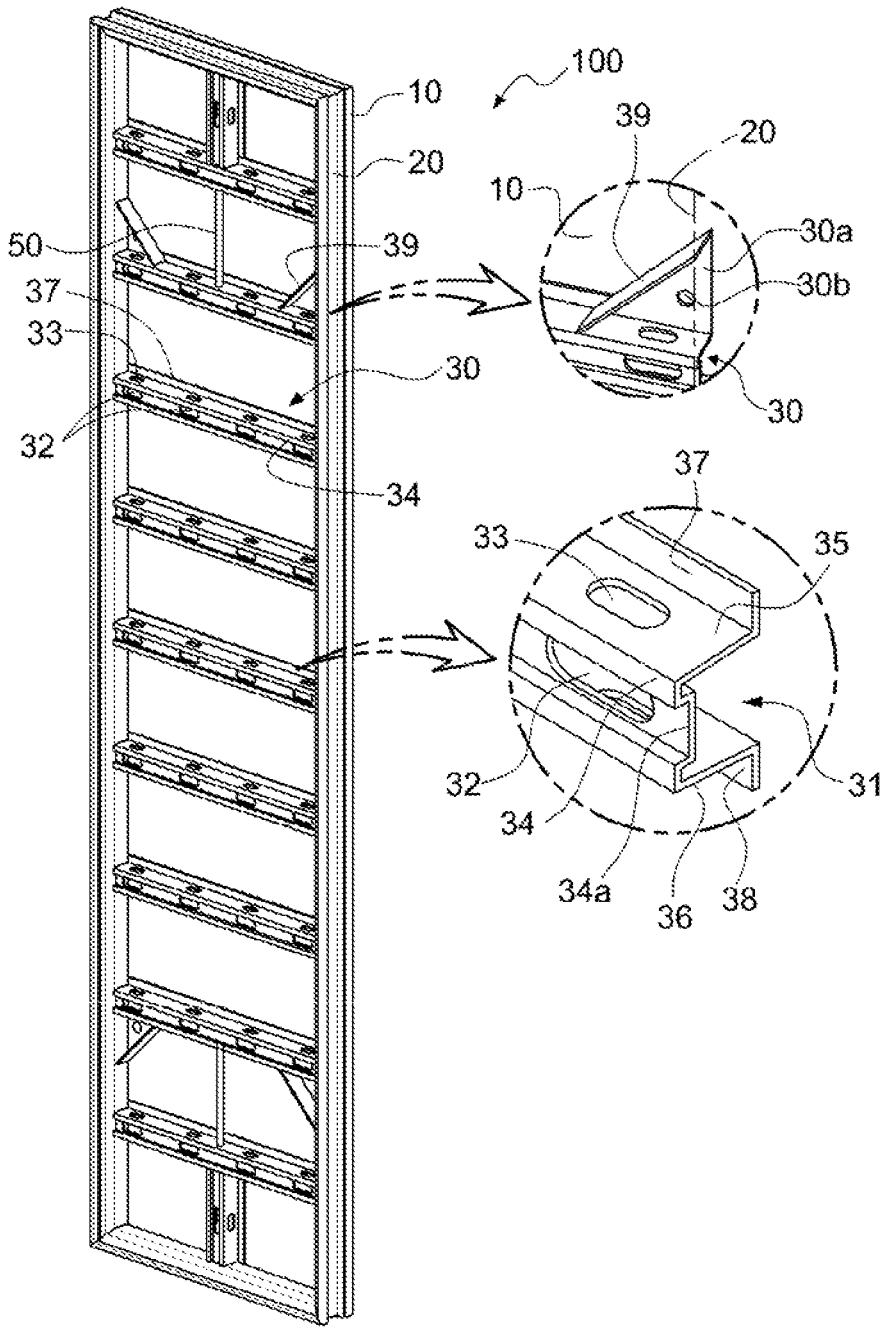
FIG. 1 is a perspective view of a wood gang form according to the present invention.
Figure 2:
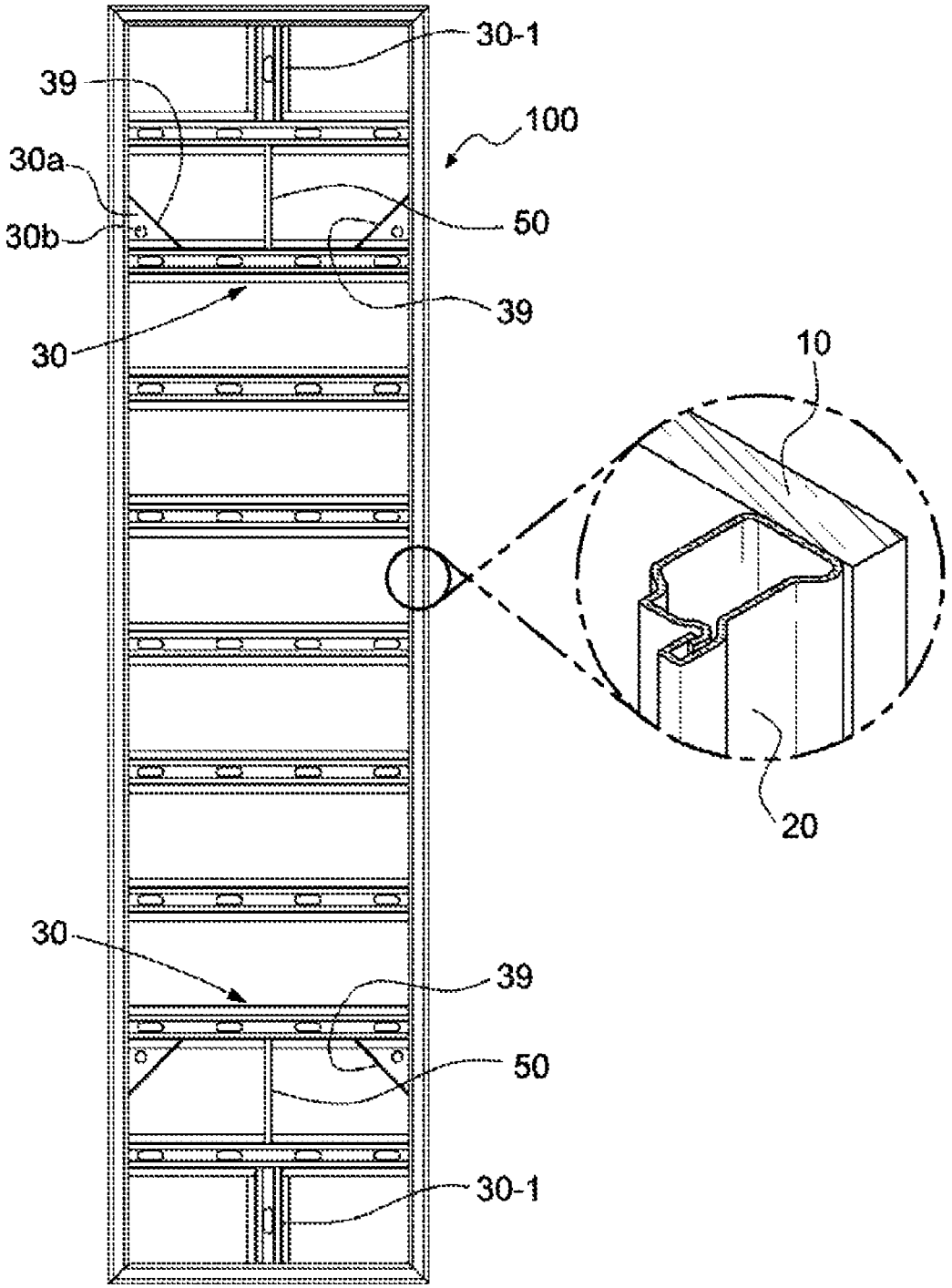
FIG. 2 is a front view of the wood gang form.

As shown in FIGS. 1 and 2, a wood gang form 100 according to the present invention is made of wood, and includes, for example, a rectangular placing plate 10, a frame 20 joined to an edge portion of one side of the placing plate 10, namely, the opposite side of a placing side, and a plurality of joist members 30 joined to one side of the placing plate 10 to reinforce the placing plate 10.

The placing plate 10 may be made with wood of various kinds, such as plywood.

The frame 20 may be made with square pipes or angles and includes upper, lower, right and left frames which are respectively joined to upper, lower, right and left edge portions of the placing plate 10 to maintain and reinforce the form of the placing plate 10.

As shown in the circle of FIG. 2, it is preferable that the frame 20 be a forming square pipe for reinforcing strength.

The joist member 30 is a stiffener for preventing transformation of the placing plate 10 by concrete placing pressure, and has the following structure in order to apply equipment for reinforcing the placing plate 10 and placing concrete, such as a lifting ring, a form tier for keeping an interval between molds, a bracing for supporting the wood gang form and a worktable for providing a work space.

The joist member 30 includes a joist body 31 which has a three-dimensional shape and is supported on the placing plate 10, and through holes 32 and 33 which are formed in the joist body 31 and to which the above-mentioned equipment is connected. All of the joist members 30 may be mounted in the same direction. Of course, the present invention is not limited to the above, and the joist members 30 can be mounted in the horizontal direction and the vertical direction. FIG. 2 illustrates an example that vertical joist members 30-1 are mounted at upper and lower portions of the placing plate 10.

The joist body 31 includes: a front portion 34; upper and lower horizontal portions 35 and 36 which respectively extend from upper and lower sides of the front portion 34 in the same direction, preferably, in parallel with each other; and upper and lower support portions 37 and 38 which respectively extend in the upward direction and in the downward direction from the upper and lower horizontal portions 35 and 36 and are supported on the placing plate 10. The joist body 31 is fixed on the placing plate 10 with nails, fixed on the frame 20 by welding, or fixed on both of the placing plate 10 and the frame 20.

The front portion 34 is generally flat in cross section, but in order to increase bending strength, may have a reinforcing portion 34*a* having a concave middle portion. The reinforcing portion 34*a* may have a convex structure.

Moreover, like the front portion, the upper and lower horizontal portions 35 and 36 may respectively have reinforcing portions.

The support portions 37 and 38 are respectively in surface contact with the placing plate 10 in order to increase joint strength between the joist members 30 and the placing plate 10.

According to the above-mentioned structure, reinforcement may be weak because the joist members 30 are mounted in one direction, and in order to make up for the weak point, a reinforcing plate 34 may be applied.

The reinforcing plate 39 is mounted at an edge portion between the joist member 30 and the frame 20 to reinforce the place where is not reinforced by the joist member 30 and the frame 20. The reinforcing plate 39 is arranged at the edge portion slantly and both sides of the longitudinal direction are respectively fixed to the joist member 30 and the frame 20 by welding to reinforce.

The reinforcing plate 39 provides a triangular space together with the frame 20 and the joist member 30, and a form tier 200 (see FIG. 3) may be mounted using the triangular space, namely, a hole for mounting the form tier is formed in the triangular space through boring. In this instance, the reinforcing plate 39 increases mounting strength of the form tier because the frame 20 and the joist member 30 support a washer plate of the form tier. As described above, in a case that the form tier 200 is mounted in the space formed by the reinforcing plate 39, when the hole is formed in the placing plate 10, the placing plate 10 may be damaged, and so, in order to prevent damage of the placing plate 10, a protection portion 30*a* is formed on the joist member 30. The protection portion 30*a* has a structure to occupy the space formed by the reinforcing plate 39 and has a hole 30*b* to make a place for the hole of the placing plate 10 so as to prevent damage of the placing plate 10 when the placing plate 10 is bored and to reinforce the place where the form tier 200 will be mounted even though the placing plate 10 is damaged.

The reinforcing plate 39 may be made with a plate, an L-shaped angle, a square pipe, a circular pipe or others.

The through holes 32 and 33 are divided into a first through hole 32 which is formed in the front portion 34, preferably, the reinforcing portion 34*a*, and is opened in the back and forth direction and a second through hole 33 which is formed in the upper and lower horizontal portions 35 and 36 in the vertical direction. The first and second through holes 32 and 33 may be formed in a circular shape, an elongated shape, an oval shape or other shapes.

The first through hole 32 provides a space for mounting the form tier 200 (see FIG. 3) to maintain an interval between the wood gang forms 100 and a space for mounting a yoke member 40 (see FIG. 4), such as a square pipe, an angle or the like.

Figure 3:
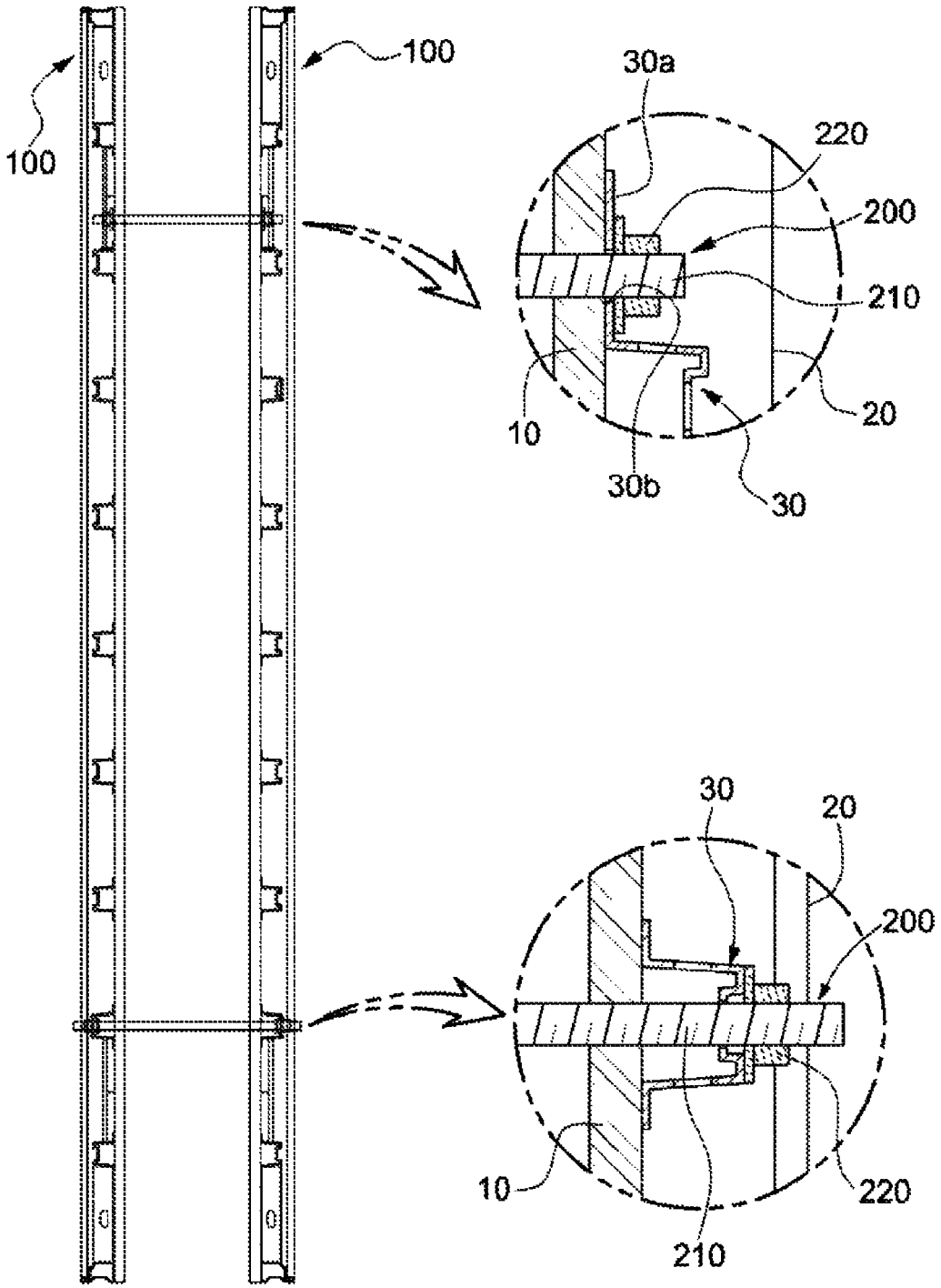
FIG. 3 is a side view of the wood gang form showing an example that a pair of the wood gang form are installed through a form tier.

As shown in FIG. 3, in a case that a wall body or a pillar is constructed, a pair of the wood gang forms 100 stand at a predetermined interval (thickness of the wall body) from each other, the form tier 200 is used to maintain the interval between the wood gang forms 100, the hole is bored in the placing plate 10 (at a construction site or when fabricated at a factory) to be communicated with the first through hole 32, and the form tier 200 is mounted when washer plates and nuts 220 are joined to both sides of the form tier 200 after a long bolt 210 of the form tier 200 is inserted into the hole bored from the first through hole 32 of one of the wood gang forms 100 and is drawn out through the bored hole and the first through hole 32 of the other wood gang form 100.

Figure 4:
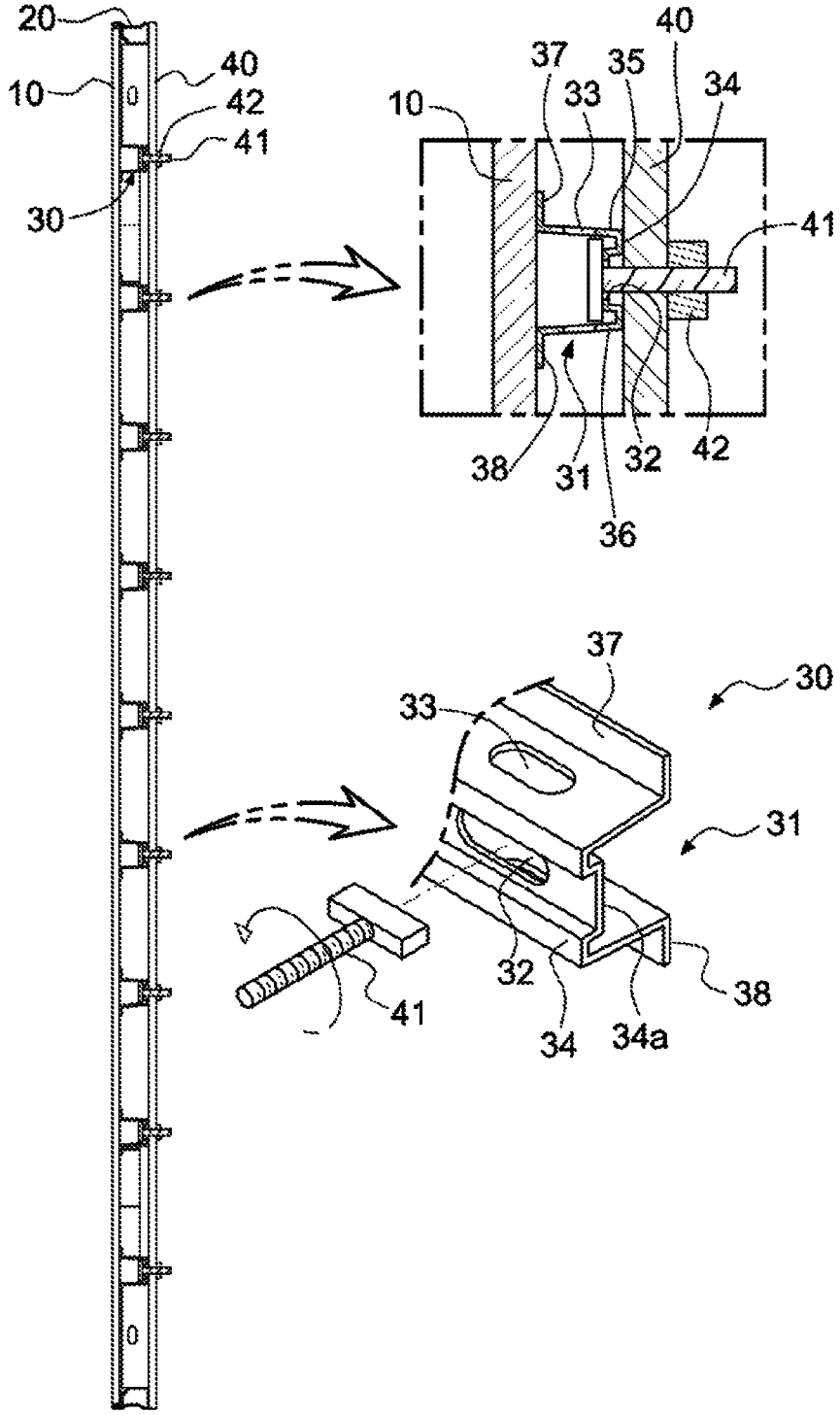
FIG. 4 is a side view showing an example that a yoke member is applied to the wood gang form.

As shown in FIG. 4, the wood gang form 100 is sufficiently reinforced just by the joist members 30, but as occasion demands, the yoke member 4 may be used together, and the yoke member 40 is mounted through the first through hole 32. A head of a T-bolt 41, which is smaller than the lateral width of the first through hole 32 but is larger than the vertical height of the first through hole 32, is inserted into the first (elongated) through hole 32 of the joist member 30 and is rotated so as to be caught and supported to the back of the first through hole 32, a screw portion of the T-bolt 41 penetrates through the hole, and then, a nut 42 is coupled to the screw portion of the T-bolt 41 so that the yoke member 40 is fixed.

The second through hole 33 is vertically formed in the upper and lower horizontal portions 34 and 35 of the joist member 30 and is used to fix a handrail, a lifting ring, a bracing, a worktable and so on.

Figure 5:
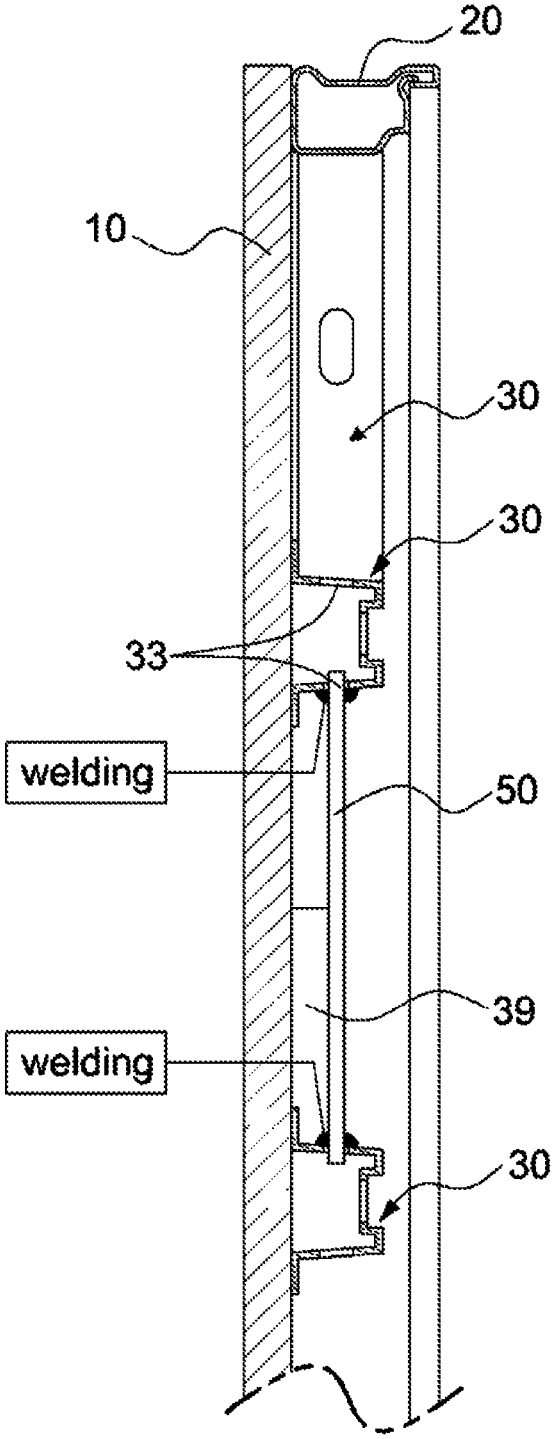
FIG. 5 is a side view showing a handrail applied to the wood gang form.

As shown in FIG. 5, the handrail 50 includes a safety rack connected with a worker in order to prevent a falling accident of the worker due to high place work and a hand-grip used when the worker ascends up on high. The handrail 50 is arranged between the joist members 30 or between the joist member 30 and the frame 20 in the vertical direction, penetrates through the second through holes 33 of the joist members 30 whose each upper portion is adjacent to the lower portion of another joist member 30, and then, is fixed by welding or by nuts. In the drawing, it is illustrated that the handrail 50 is welded in a state where the upper portion of the handrail 50 penetrates only the lower horizontal portion 35 of the joist member 30 of the upper part and the lower portion of the handrail 50 penetrates only the upper horizontal portion 34 of the joist member 30 of the lower part. However, the present invention is not limited to the above, but it is also possible that the upper and lower portions of the handrail 50 are welded to be fixed after penetrating all of the upper and lower horizontal portions 34 and 35.

Preferably, the handrail 50 protects the worker but does not interfere movement of the worker, and is circular in cross section so that the worker can easily grip.

Figure 6:
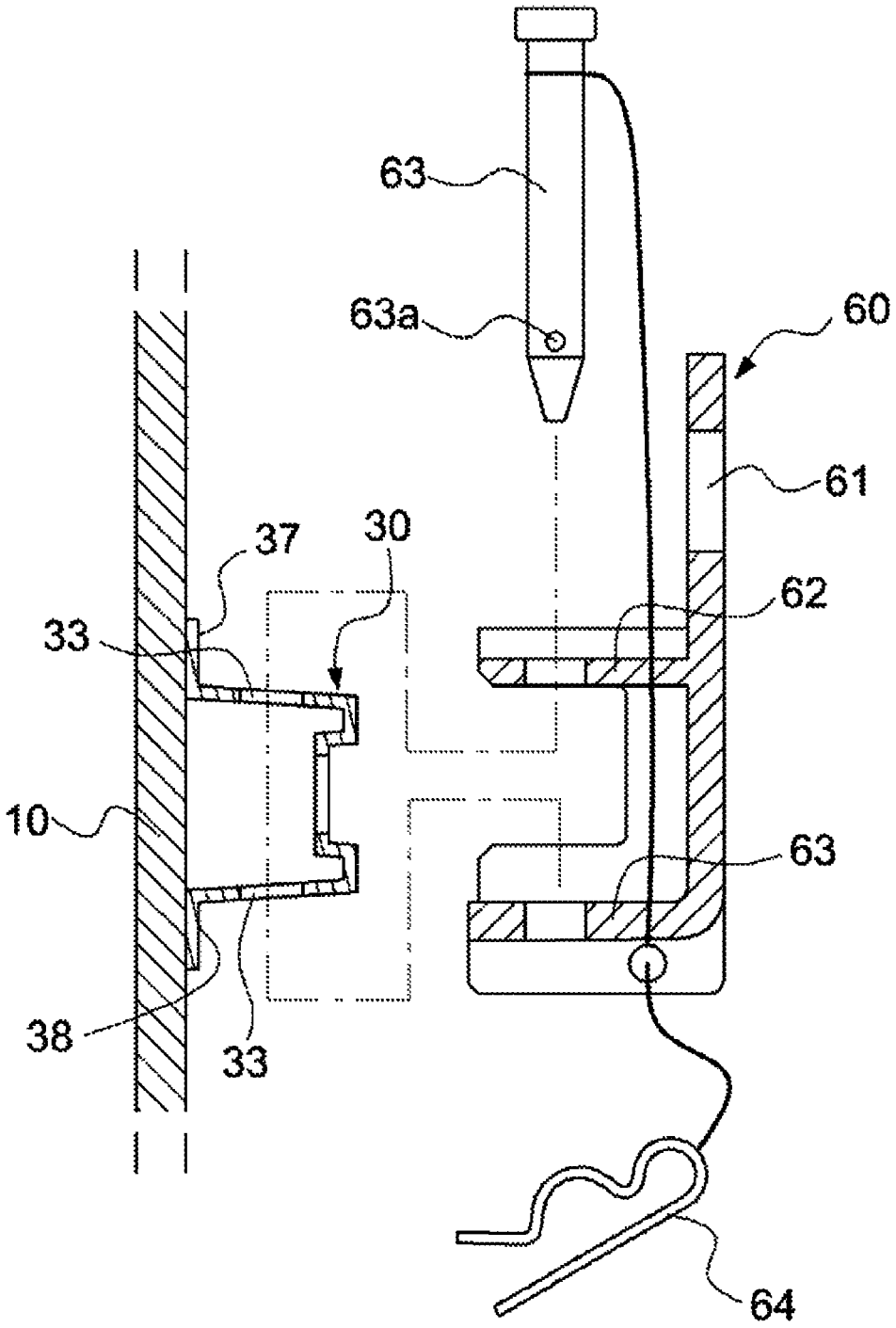
FIG. 6 is a side view showing an example that a lifting ring is applied to the wood gang form.
Figure 7:
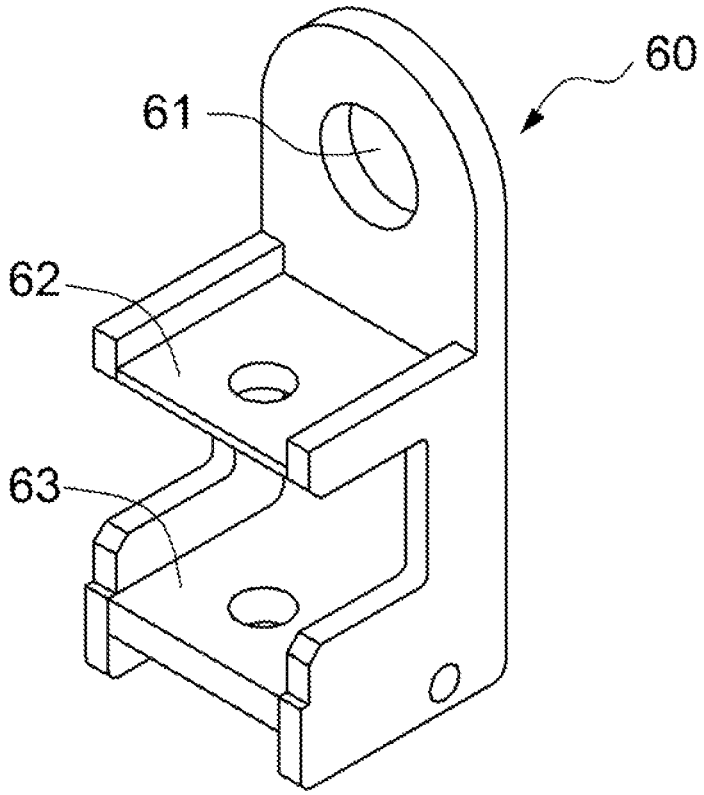
FIG. 7 is a perspective view showing the example that the lifting ring is applied to the wood gang form.

As shown in FIGS. 6 and 7, the lifting ring 60 is mounted on the wood gang form 100 and is connected with a hoist only when the wood gang form 100 is lifted. The lifting ring 60 includes: a ring part 61 to which a hook or a wire of the hoist is connected and which is formed in a hole type or a hook type; a socket part 62 surrounding the joist member 30; a connection pin 63 vertically joined to the socket part 62 and the second through hole 33 of the joist member 30; and a locking pin 64 joined to the connection pin 63 so that the connection pin 63 is not separated from the socket part 62 and the joist member 30.

The socket part 62 is fixed integrally with the ring part 61 or fixed to the ring part 61 by welding, and includes: upper and lower cover portions each of which has a pin hole to surround the upper and lower horizontal portions 34 and 35 of the joist member 30 at both upper and lower sides; and side wall portions which are respectively formed at right and left sides of the cover portions.

In order to provide easy handling and prevent loss, the connection pin 63 and the locking pin 64 are, for example, connected to the socket part 62 through a connection wire or chain, and the locking pin 64 is fit into a locking hole **63*a* formed in the connection pin 63 so as to prevent separation of the connection pin 63**.

Figure 8:
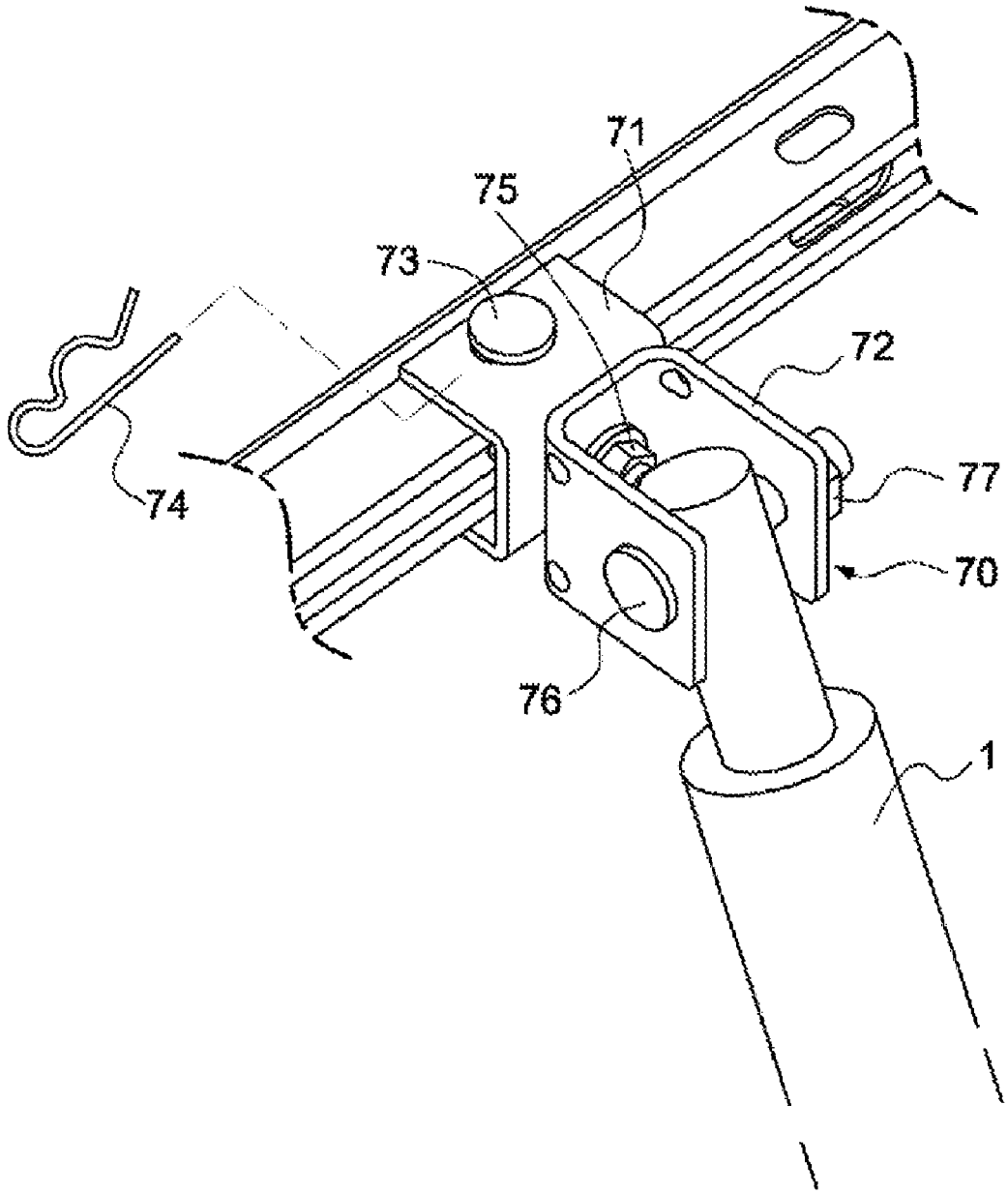
FIG. 8 is a view showing a state where a bracing is connected to the wood gang form through a bracing head.

As shown in FIG. 8, the bracing is connected to the joist member 30 through a bracing head 70.

The bracing head 70 includes a joist fixing part 71 and a bracing connection part 72.

The joist fixing part 71 includes: upper and lower horizontal portions which surround the upper and lower parts of the joist member 30 and each of which has a pin hole; and a vertical portion for connecting the upper and lower horizontal portions with each other. Like the lifting ring 60, the joist fixing part 71 is detachably fixed to the joist member 30 using the second through hole 33 of the joist member 30 by a connection pin 73 and a locking pin 74.

The bracing connection part 72 is connected with the joist fixing part 71 through a fastener 75, and in this instance, may be connected with the joist fixing part 71 to be adjustable in angle.

The bracing connection part 72 includes: right and left wall body portions formed to surround a bracing 1; a connection portion for connecting the wall body portions; a connection pin 76 which penetrates the wall body portions and the bracing 1 interposed between the wall body portions; and a locking pin 77 for locking the connection pin 76.

Connection pins 73 and 76 and locking pins 74 and 77 which are applied to the bracing head 70 are respectively connected to the joist fixing part 71 and the bracing connection part 72 through connection wires or chains.

Figure 9:
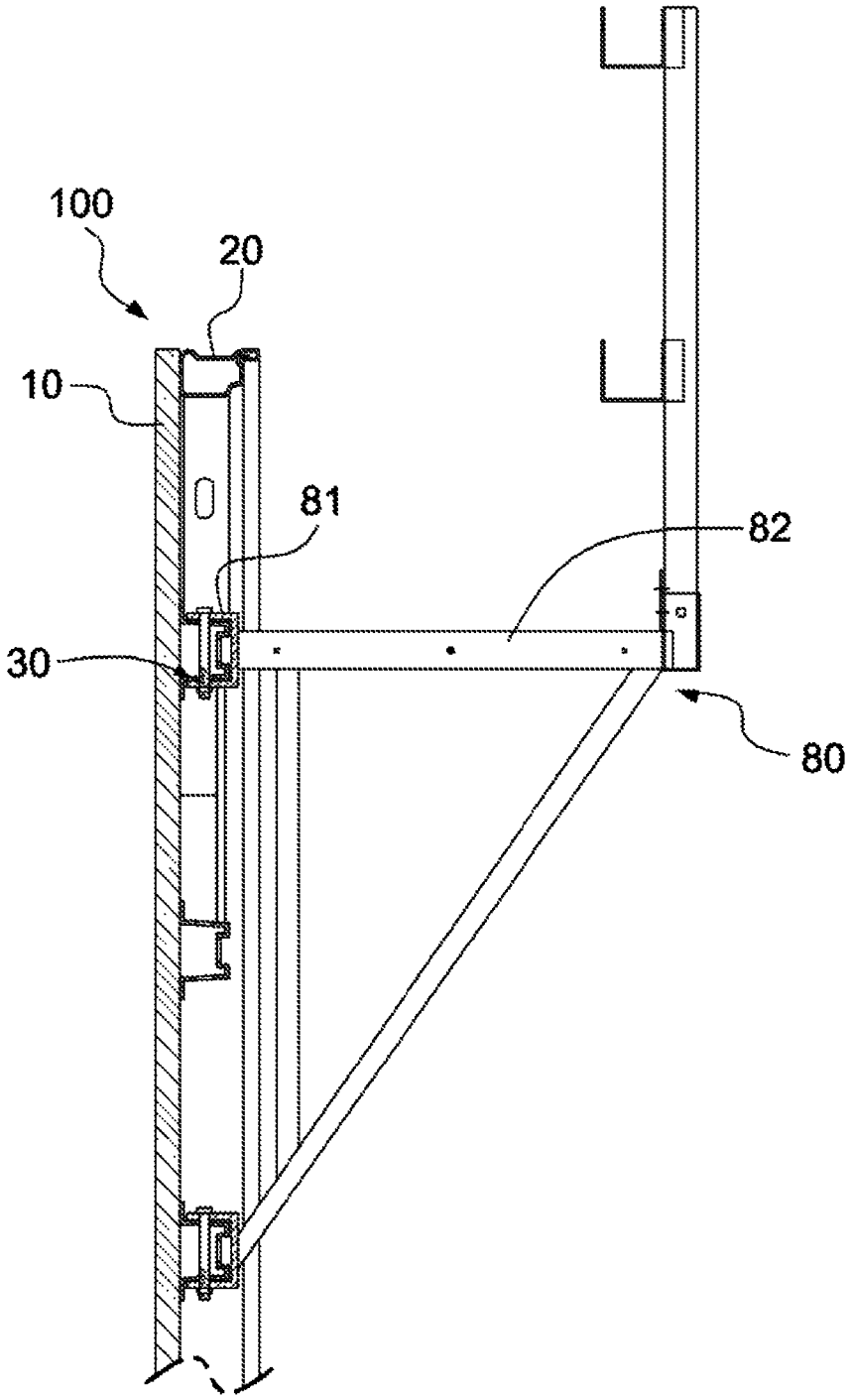
FIG. 9 is a side view showing an example that a worktable is mounted on the wood gang form.

As shown in FIG. 9, through the above structure, the worktable 80 is also fixed to the joist member 30 through the second through hole 33. The worktable 80 includes: a worktable frame 81 having a horizontal portion and an inclined portion; a foothold 82 which is made of wood or others and is mounted on the horizontal portion of the worktable frame 81; a guardrail 83 standing at the outer edge of the worktable frame 81; connecting means which are respectively mounted at end portions of the horizontal portion and the inclined portion of the worktable frame 81 to be connected to the joist member 30. The connecting means is formed in the same way as the lifting ring 60, and includes: a socket part surrounding the upper and lower horizontal portions 34 and 35 of the joist member 30, a connection pin joined to the socket part and the second through hole of the joist member 30 inside the socket part, and a locking pin joined to the connection pin.

Figure 10:
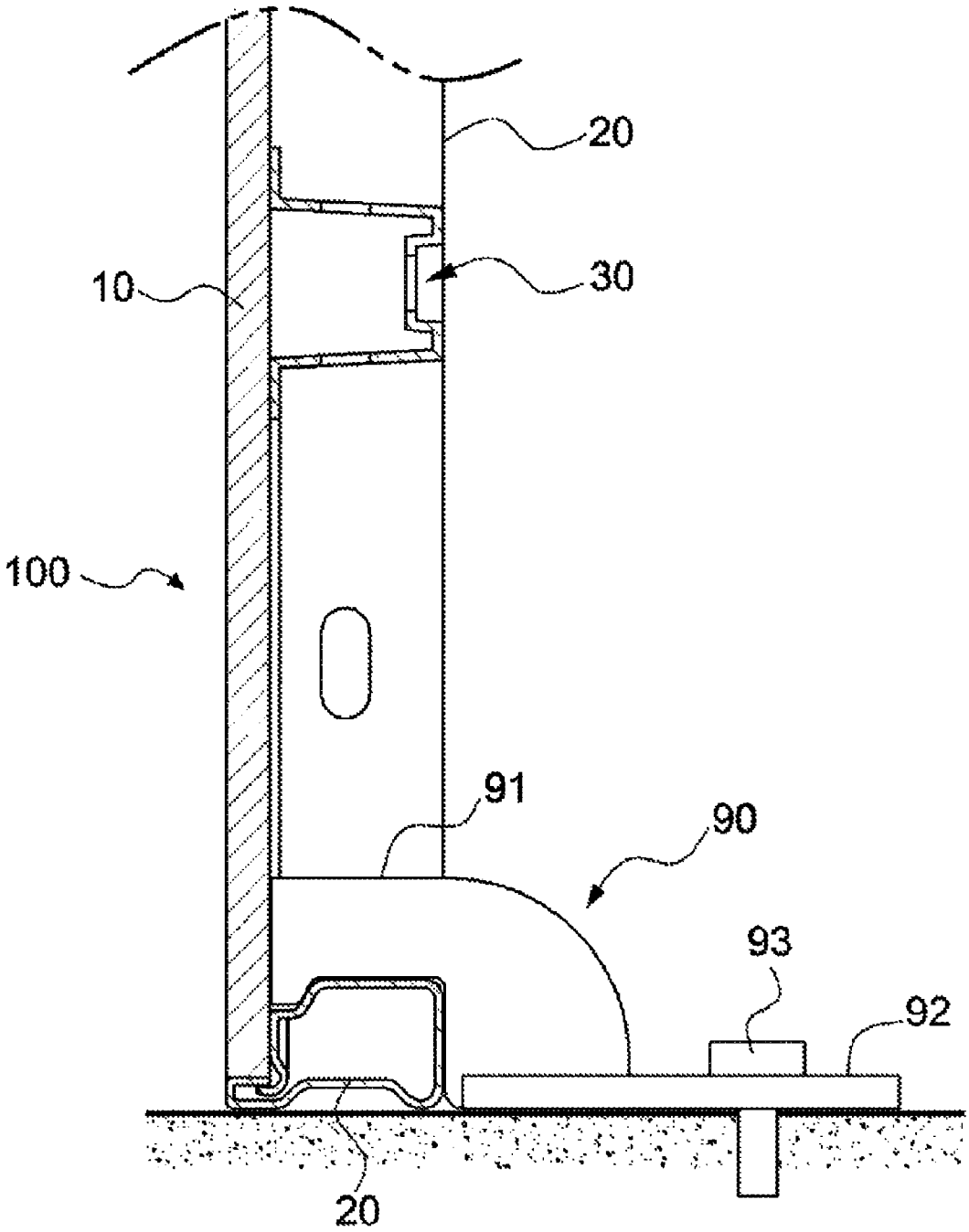
FIG. 10 is a side view showing a fixing kicker applied to the wood gang form.
Figure 11:
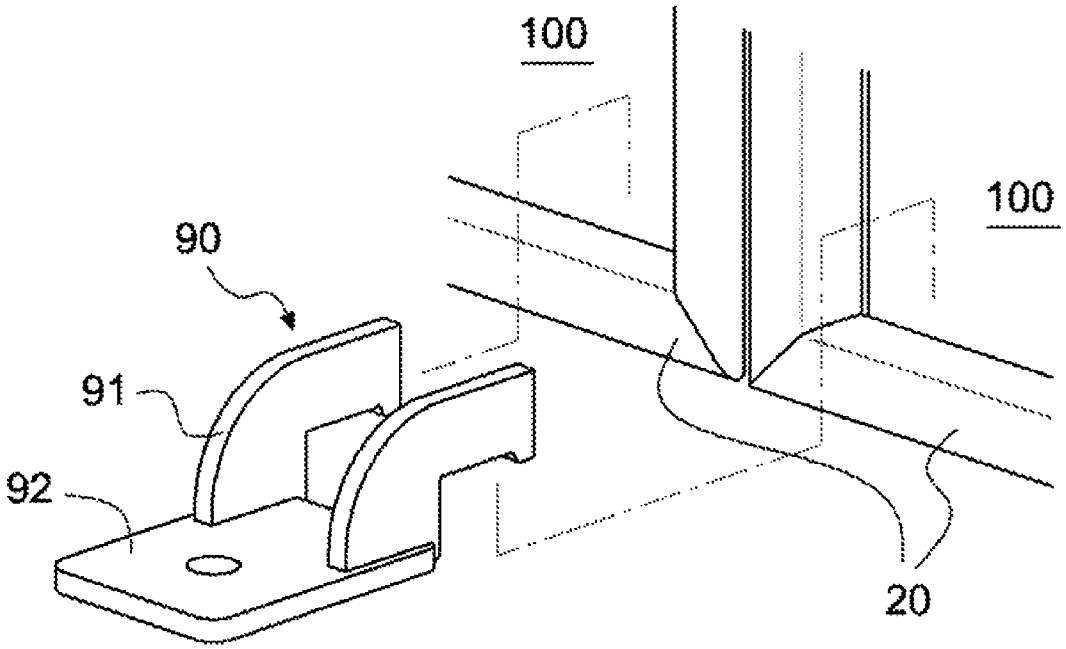
FIG. 11 is a perspective view showing the fixing kicker applied to the wood gang form.

As shown in FIGS. 10 and 11, a fixing kicker 90 may be applied to the wood gang form 100 so that the wood gang form 100 is installed on the ground stably.

The fixing kicker 90 includes: at least one frame fixing part 91 which is caught and fixed to a retaining jaw 21 formed on the frame 20; and a seating part 92 which extends from the frame fixing part 91 and is fixed through an anchor 93 supported on the ground and fixed in the ground, namely, through an anchor hole through which the anchor 93 is supported.

The frame fixing part 91 is formed in a plate type and has a jaw which is formed at the bottom portion of the front end portion to be caught and supported to the retaining jaw 21.

The fixing kicker 90 can fix the wood gang form 100 on the ground because the fixing kicker 90 can be connected to the frame using only one frame fixing part 91. However, if two frame fixing parts 91 are used, as shown in FIG. 11, the fixing kicker 90 can join the neighboring wood gang forms 100 because the two frame fixing parts 91 are respectively supported to the frames 20 of the two neighboring wood gang forms 100.

For use of the wood gang forms 100 according to the present invention, a plurality of the wood gang forms 100 are arranged in vertical and horizontal directions and joined with each other through clamps according to the size of the building. The clamps may be all kinds of the well-known products.

Now, a method for constructing a concrete building using the wood gang form according to the present invention will be described as follows.

1. Assembly of Prefabricated Wood Gang Forms

According to the size of a building, the number of the wood gang forms 100 is selected, and then, the wood gang forms 100 are assembled with clamps. Of course, the building may be constructed using just one wood gang form 100, but, in this specification, an example that a plurality of the wood gang forms 100 are used to construct a building.

Additionally, the lifting ring 60 for lifting the wood gang form assembly, the bracing head 70 for connecting the bracing 1, and the worktable 80 for providing a work space are assembled to the wood gang form assembly, but detailed descriptions thereof will be omitted because the assembly of the equipment is practicable through the above-mentioned configuration.

If a mounting location of the form tier is decided, the hole for mounting the form tier is bored in the placing plate 10 of the wood gang form 100 in such a way that the hole is communicated with the first through hole 32.

The lifting ring 60, the bracing head 70 and the worktable 80 are assembled at the optimum positions according to the size of the building. Moreover, the bracing head 70 may be assembled after the wood gang form assembly is installed.

2. Lifting of Wood Gang Form Assembly

After the hoist is connected to the ring part 61 of the lifting ring 60 assembled to the wood gang form assembly, the hoist lifts the wood gang form assembly, and then, carries the wood gang form assembly to a construction site.

3. Installation of Wood Gang Form Assembly

The wood gang form assembly is erected and installed to be suitable for the structure (wall bodies, pillars and so on) of the building.

After the wood gang form assembly is installed, the upper part of the bracing 1 is assembled to the bracing head 70 assembled to the wood gang form assembly, and the lower part is fixed on the ground.

When the location of the wood gang form assembly is decided, the fixing kicker 90 is combined and anchored to the bottom portion of the wood gang form assembly to install the wood gang form assembly stably.

The lifting ring 60 and the bracing head 70 can be easily separated from the wood gang form 100 just through separation of the locking pins and the connection pins. Therefore, if there is an interference between installation of the wood gang form assembly and other work when the wood gang form assembly is installed or if the location is changed by a change of design, the lifting ring 60 and the bracing head 70 are separated, and then, are mounted at other locations.

In the meantime, when the wall bodies and the pillars are constructed, the wood gang form assemblies which face each other are tied using the form tier 200. First, a hole is bored in the placing plate 10 according to the mounting position of the form tier 200 in such a way that the hole is communicated with the first through hole 32 of the joist member 30. After that, the long bolt 210 of the form tier 200 is inserted into the bored hole and the first through hole 32, and then, the washer plates and the nuts 220 are fastened at both sides of the form tier 200, so that the form tier 200 is installed and the wood gang form assemblies are tied.

4. Concrete Placing

The building is constructed through the steps of placing concrete in the space formed by the wood gang form assembly and curing the concrete.

5. Removal of Form

When the concrete is cured, the wood gang form assembly is removed. In a case that the bracing 1 is used, the bracing 1 is separated from the bracing head 70 or the bracing head 70 is separated from the wood gang form assembly, and in a case that the form tier 200 is mounted, the form tier 200 is disassembled.

After all of the components are completely disassembled and removed, the hoist is connected to the lifting ring 60 to remove the wood gang form assembly and carry the wood gang form assembly to another place.

Some of the above-mentioned processes require the worker's hand work. The worker works while moving along the worktable 80 in safety after locking a safety hook to the handrail 50 or works while ascending with the hand holding the handrail 50, alternatively, while ascending using the joist members 30 as stairs. Therefore, because the worker can do high place work in safety, the present invention can prevent the worker's falling accident and reduce working hours.

What is claimed is:

1. A wood gang form comprising:

a placing plate made with wood;

a frame joined to an edge of one side of the placing plate; and joist members which are arranged on one side of the placing plate at a predetermined interval from each other, are joined to one of the placing plate and the frame to reinforce the placing plate or the frame, wherein each of the joist members includes: a joist body which has a three-dimensional shape and is supported on the placing plate; and one or more through holes which are formed in the joist body in a circular form or an elongated form and to which equipment for placing concrete is connected, the through holes being a first through hole which penetrates a front portion of the joist body in a back and forth direction and a second through hole which penetrates at least one of the upper and lower portions of the joist body in a vertical direction, wherein the joist body includes:

a front portion having the first through hole; upper and lower horizontal portions which are bent from upper and lower portions of the front portion toward the placing plate and have the second through hole; and upper and lower support portions which are respectively bent in an upward direction and in a downward direction from the upper and lower horizontal portions and are supported on the placing plate.

2. The wood gang form according to claim 1, further comprising:

a handrail which is interposed between the joist members and is fixed on the joist members adjacent to each other in a longitudinal direction or fixed on the joist body and the frame, to which a worker's safety hook is connected or which is used as a hand-grip, the handrail being welded after penetrating through the second through holes of the neighboring joist members or welded on sides of the joist members.

3. The wood gang form according to claim 2, further comprising:

a reinforcing plate which is mounted at an edge portion between the joist body and the frame, is arranged at the edge portion slantly in such a way that both sides of the reinforcing plate are respectively fixed to the joist body and the frame so as to provide the edge portion with a space for mounting a form tier.

4. The wood gang form according to claim 1, further comprising:

a reinforcing plate which is mounted at an edge portion between the joist body and the frame, is arranged at the edge portion slantly in such a way that both sides of the reinforcing plate are respectively fixed to the joist body and the frame so as to provide the edge portion with a space for mounting a form tier.

5. The wood gang form according to claim 4, wherein the each of the joist members further comprises a protection portion which protects and reinforces the placing plate by occupying the space formed by the reinforcing plate and has a hole.

6. The wood gang form according to claim 1, further comprising:

at least one yoke member which is arranged on an outer face of the joist body at right angles to the joist body and is mounted through a fixture connected and fixed to the first through hole.

7. The wood gang form according to claim 1, further comprising:

a fixing kicker which is connected to the frame and is supported and anchored on the ground.

8. The wood gang form according to claim 7, wherein the fixing kicker comprises:

at least one frame fixing part which is caught and fixed to a retaining jaw formed on the frame; and a seating part which extends from the frame fixing part and is fixed through an anchor supported on the ground and fixed in the ground.

9. The wood gang form according to claim 1, further comprising:

a worktable including: a worktable frame having a horizontal portion and an inclined portion; a foothold which is mounted on the horizontal portion of the worktable frame; and a guardrail standing at an outer edge of the worktable frame, wherein the horizontal portion and the inclined portion of the worktable frame are detachably mounted on the joist body through connecting means joined to the second through hole.

10. A wood gang form comprising:

a placing plate made with wood;

a frame joined to an edge of one side of the placing plate; and joist members which are arranged on one side of the placing plate at a predetermined interval from each other, are joined to one of the placing plate and the frame to reinforce the placing plate or the frame, wherein each of the joist members includes: a joist body which has a three-dimensional shape and is supported on the placing plate; and one or more through holes which are formed in the joist body in a circular form or an elongated form and to which equipment for placing concrete is connected, the through holes being a first through hole which penetrates a front portion of the joist body in a back and forth direction and a second through hole which penetrates at least one of the upper and lower portions of the joist body in a vertical direction; and a lifting ring which is detachably joined to the joist body and is connected to a hoist, wherein the lifting ring comprises: a ring part to which a hook or a wire of the hoist is connected; a socket part surrounding the joist body; a connection pin joined to the socket part and the second through hole; and a locking pin joined to the connection pin so that the connection pin is not separated from the socket part and the joist body.

11. A wood gang form comprising:

a placing plate made with wood;

a frame joined to an edge of one side of the placing plate; and joist members which are arranged on one side of the placing plate at a predetermined interval from each other, are joined to one of the placing plate and the frame to reinforce the placing plate or the frame, wherein each of the joist members includes: a joist body which has a three-dimensional shape and is supported on the placing plate; and one or more through holes which are formed in the joist body in a circular form or an elongated form and to which equipment for placing concrete is connected, the through holes being a first through hole which penetrates a front portion of the joist body in a back and forth direction and a second through hole which penetrates at least one of the upper and lower portions of the joist body in a vertical direction; and a bracing head which is detachably joined to the joist body and to which a bracing is connected, wherein the bracing head comprises: a joist fixing part which surrounds the joist body; a bracing connection part which is joined to the joist fixing part and to which the bracing is fixed; a connection pin which is joined to the joist fixing part and the second through hole; and a locking pin which is joined to the connection pin so that the connection pin is not separated from the joist fixing part and the joist body.

* * * * *